US006763791B2

(12) United States Patent
Gardner et al.

(10) Patent No.: US 6,763,791 B2
(45) Date of Patent: Jul. 20, 2004

(54) CAM PHASER FOR ENGINES HAVING TWO CHECK VALVES IN ROTOR BETWEEN CHAMBERS AND SPOOL VALVE

(75) Inventors: Marty Gardner, Ithaca, NY (US); Michael Duffield, Medina, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/198,476

(22) Filed: Jul. 18, 2002

(65) Prior Publication Data

US 2003/0033999 A1 Feb. 20, 2003

Related U.S. Application Data

(60) Provisional application No. 60/312,140, filed on Aug. 14, 2001.

(51) Int. Cl.[7] ..... F01L 1/34
(52) U.S. Cl. ..... 123/90.17; 125/90.15
(58) Field of Search ..... 123/90.13, 90.15

(56) References Cited

U.S. PATENT DOCUMENTS

| | | | | |
|---|---|---|---|---|
| 5,002,023 A | | 3/1991 | Butterfield et al. | 123/90.15 |
| 5,107,804 A | | 4/1992 | Becker et al. | 123/90.17 |
| 5,172,659 A | * | 12/1992 | Butterfield et al. | 123/90.17 |
| 5,184,578 A | | 2/1993 | Quinn, Jr. et al. | 123/90.17 |
| 5,361,735 A | | 11/1994 | Butterfield et al. | 123/90.17 |
| 5,367,992 A | | 11/1994 | Butterfield et al. | 123/90.17 |
| 5,386,807 A | | 2/1995 | Linder | 123/90.17 |
| 5,497,738 A | * | 3/1996 | Siemon et al. | 123/90.17 |
| 5,657,725 A | | 8/1997 | Butterfield et al. | 123/90.17 |
| 6,024,061 A | | 2/2000 | Adachi et al. | 123/90.17 |
| 6,053,138 A | | 4/2000 | Trzmiel et al. | 123/90.17 |
| 6,085,708 A | | 7/2000 | Trzmiel et al. | 123/90.17 |
| 6,182,622 B1 | | 2/2001 | Goloyatai-Schmidt et al. | 123/90.15 |
| 6,481,402 B1 | * | 11/2002 | Simpson et al. | 123/90.17 |

FOREIGN PATENT DOCUMENTS

| | | | |
|---|---|---|---|
| EP | 0801212 A1 | 10/1997 | F01L/1/344 |

* cited by examiner

*Primary Examiner*—Thomas Denion
*Assistant Examiner*—Zelalem Eshete
(74) *Attorney, Agent, or Firm*—Brown & Michaels PC; Greg Dziegielewski

(57) ABSTRACT

An infinitely variable camshaft timing device (phaser) has a control valve located in the rotor. Since the control valve is in the rotor, the camshaft need only provide a single passage for supplying engine oil or hydraulic fluid, and does not need multiple passageways for controlling the phaser, as in the prior art. Two check valves, an advance chamber check valve and a retard chamber check valve, are also located in the rotor. The check valves are located in the control passages for each chamber. The main advantage of putting the check valves in the advance and retard chambers instead of having a single check valve in the supply is to reduce leakage. This design also eliminates high pressure oil flow across the spool valve and improves the response time of the check valve to the torque reversals due to a shorter oil path. In addition, the phaser of the present invention outperforms an oil pressure actuated device and consumes less oil.

14 Claims, 6 Drawing Sheets

CAM PHASER FOR ENGINES HAVING TWO CHECK VALVES IN ROTOR BETWEEN CHAMBERS AND SPOOL VALVE

REFERENCE TO RELATED APPLICATIONS

This application claims an invention which was disclosed in Provisional Application No. 60/312,140, filed Aug. 14, 2001, entitled "TORSIONAL ASSISTED CAM PHASER FOR FOUR CYLINDER ENGINES HAVING TWO CHECK VALVES IN ROTOR BETWEEN CHAMBERS AND SPOOL VALVE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to an infinitely variable camshaft indexer with a spool valve and two check valves in the center of the rotor.

2. Description of Related Art

There are many advantages to variable cam timing, such as improving emissions, fuel economy and power density. One method of cam phasing uses a vane type cam phaser or Oil Pressure Actuated device (OPA). The performance of this device is dependent on oil pressure, which is typically a function of engine speed. Therefore, at low speeds (especially when the engine is idle), the Oil Pressure Actuated device has unacceptable performance. A second method of cam phasing, "Cam Torque Actuated" (CTA) phasing, captures the cam torsional energy with check valves and recirculates the oil chamber to chamber. Cam Torque Actuated technology works well on I3, V6 and V8 engines because of the amplitude of the cam torques across the speed range. However, Cam Torque Actuated technology does not work as well on 4-cylinder engines across the entire speed range. Therefore, there is a need in the art for technology which works well on 4-cylinder engines.

There have been a number of VCT systems patented in the past.

U.S. Pat. No. 5,386,807 uses torque effects at high speed, and engine pressure at low speed. The control valve is in the phaser core. The phaser has a built-in oil pump to provide oil pressure at low speeds. The oil pump is preferably electromagnetically controlled.

U.S. Pat. No. 6,053,138 discloses a device for hydraulic rotational angle adjustment of a shaft to a drive wheel, especially the camshaft of an internal combustion engine. This device has ribs or vanes that are nonrotatably connected with the shaft. These ribs or vanes are located in the compartments of a compartmented wheel. The compartments of the compartmented wheel and the ribs and/or vanes produce pressure chambers by whose hydraulic pressurization the two structural elements can be rotated relative to one another. In order to reduce undesired rotation when an insufficient adjusting or retaining pressure is present, a common end face of the compartmented wheel and of the ribs and/or vanes works with an annular piston that exerts a releasable clamping action on the parts that are rotatable relative to one another.

A related patent, U.S. Pat. No. 6,085,708, shows a device for changing the relative rotational angle of the camshaft of an internal combustion engine relative to its drive wheel. This device has an inner part connected with ribs or vanes that is located rotationally movably in a compartmented wheel. This driven compartmented wheel has a plurality of compartments distributed around the circumference divided by ribs or vanes into two pressure chambers each. The change in rotational angle is produced by their pressurization. To minimize the influence of overlapping alternating torque influences from the valve drive of the internal combustion engine, a damping structure is integrated into this device to hydraulically damp the change in rotational position.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The Engine Control Unit receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

In all the systems described above, the controls for camshaft timing are located in the camshaft itself, or downstream of the camshaft, increasing the likelihood for leakage as the hydraulic fluid moves from the spool valve into the vanes of the rotor. Therefore, there is a need in the art for an infinitely variable VCT multi-position cam indexer which decreases leakage during operation.

SUMMARY OF THE INVENTION

The present invention is an infinitely variable camshaft timing device (phaser) with a control valve located in the rotor. Since the control valve is in the rotor, the camshaft need only provide a single passage for supplying engine oil or hydraulic fluid, and does not need multiple passageways for controlling the phaser, as in the prior art. Two check valves, an advance chamber check valve and a retard chamber check valve, are also located in the rotor. The check valves are located in the control passages for each chamber. The main advantage of putting the check valves in the advance and retard chambers instead of having a single check valve in the supply is to reduce leakage. This design also eliminates high pressure oil flow across the spool valve and improves the response time of the check valve to the torque reversals due to a shorter oil path. In addition, the phaser of the present invention outperforms an oil pressure actuated device and consumes less oil.

The rotor is connected to the camshaft, and the outer housing and gear move relative to the rotor and camshaft. Source oil is supplied through the center of the camshaft. The position of the spool valve determines if the phaser will advance or retard.

DETAILED DESCRIPTION OF THE INVENTION

Most engines have acceptable cam torques at idle to actuate a cam phaser. However, the $4^{th}$ order cam torques decrease with engine speed, and at high speeds, a cam phaser will not actuate solely on cam torque and requires hydraulic force. This problem is especially common in 4-cylinder engines. The present invention uses engine oil pressure and is assisted by cam torsional energy to actuate the cam phaser, which is referred to as "Torsional Assist" (TA). The check valves in this design eliminate torque reversals caused by the cam torsionals and improve actuation rate.

An internal combustion engine has a crankshaft driven by the connecting rods of the pistons, and one or more camshafts, which actuate the intake and exhaust valves on the cylinders. The timing gear on the camshaft is connected to the crankshaft with a timing drive, such as a belt, chain or gears. Although only one camshaft is shown in the figures, it will be understood that the camshaft may be the only camshaft of a single camshaft engine, either of the overhead camshaft type or the in-block camshaft type, or one of two (the intake valve operating camshaft or the exhaust valve operating camshaft) of a dual camshaft engine, or one of four camshafts in a "V" type overhead cam engine, two for each bank of cylinders.

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

Figure 1:
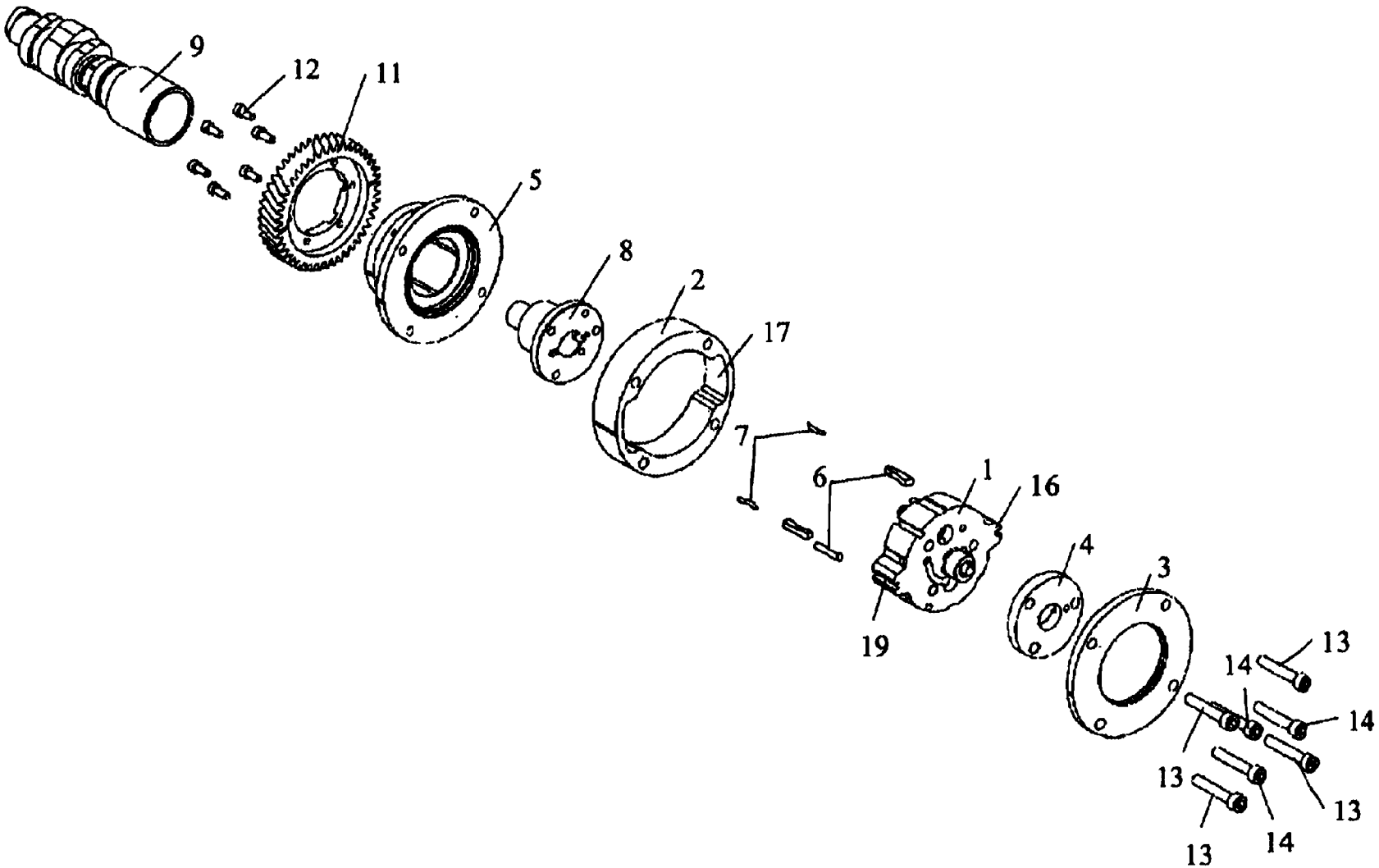
FIG. 1 shows a blown-up side view of the camshaft in an embodiment of the present invention.
Figure 2:
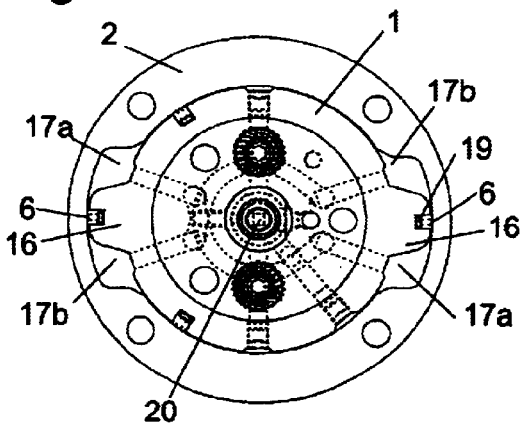
FIG. 2 shows a top-down view of the camshaft of FIG. 1.
Figure 3:
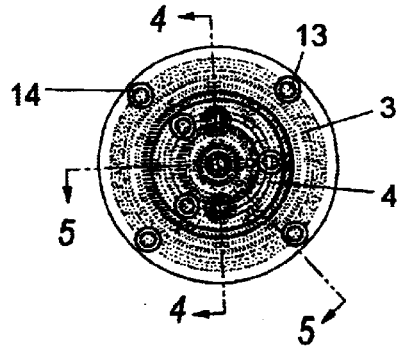
FIG. 3 shows a less-detailed top-down view of the camshaft of FIG. 1.
Figure 4:
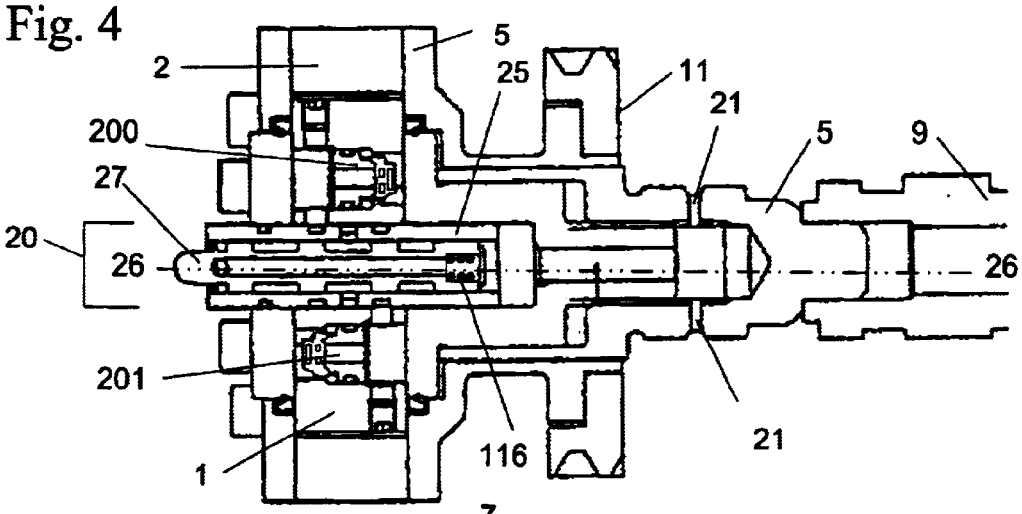
FIG. 4 shows a fragmentary view of the camshaft taken along line 4—4 of FIG. 3.
Figure 5:
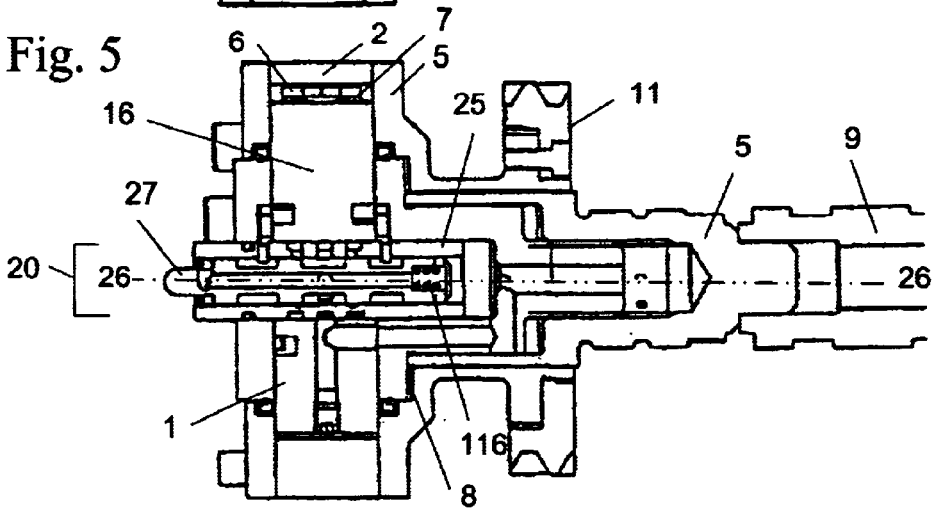
FIG. 5 shows a fragmentary view of the camshaft taken along line 5—5 of FIG. 3.
Figure 6:
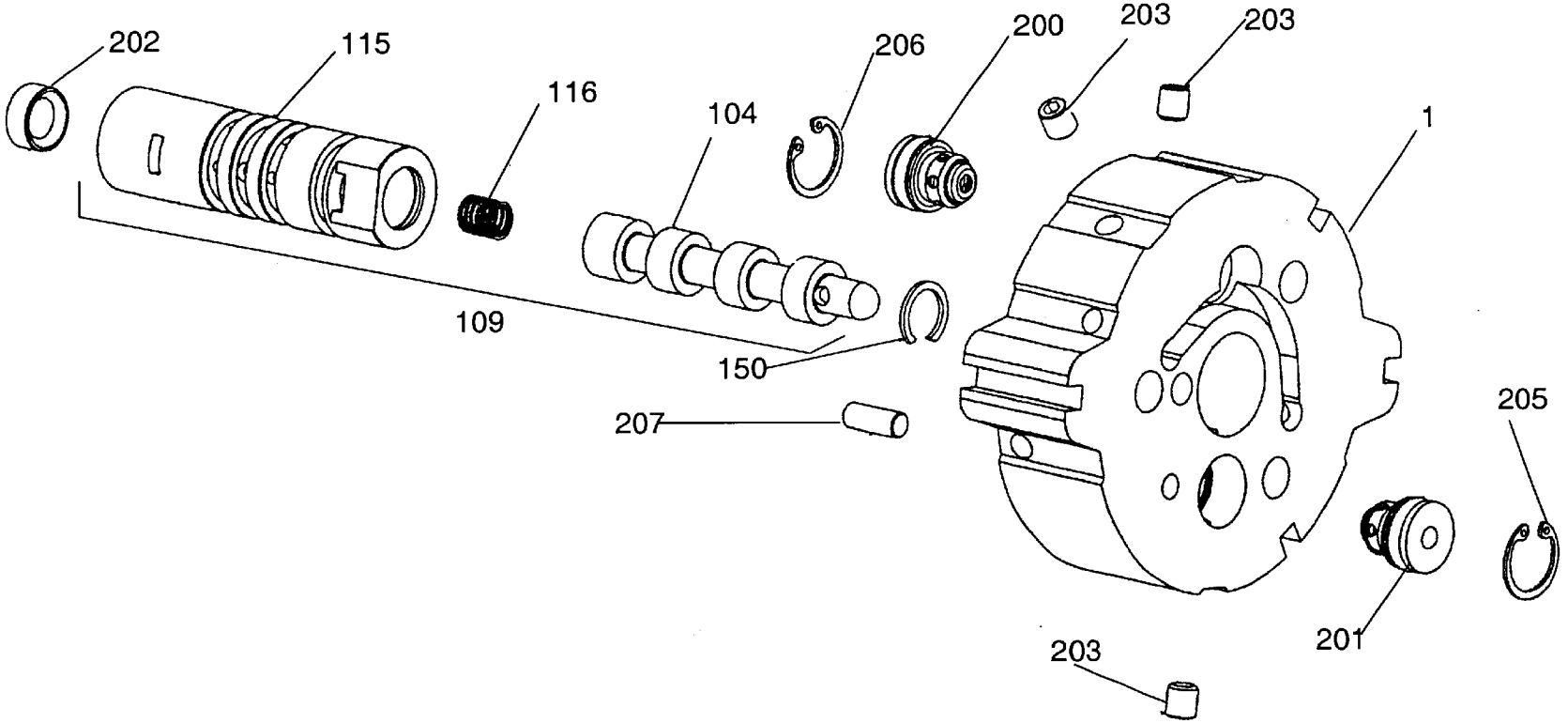
FIG. 6 shows a blown-up side view of the rotor in an embodiment of the present invention.
Figure 7:
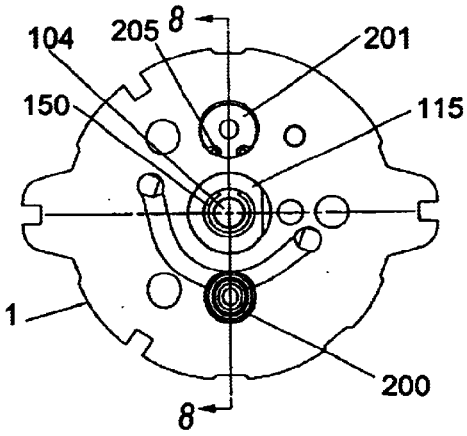
FIG. 7 shows a top-down view of the rotor of FIG. 6.
Figure 8:
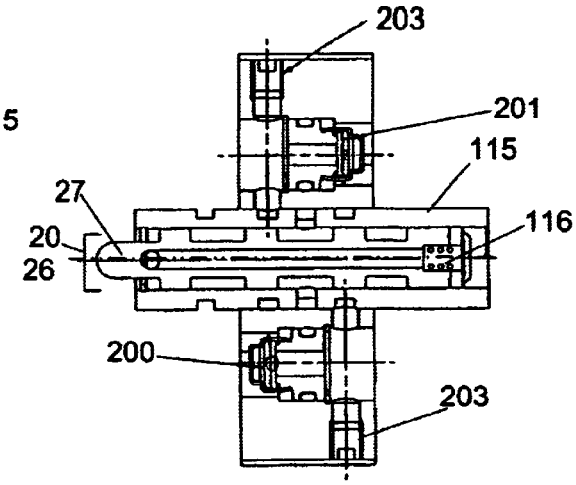
FIG. 8 shows a fragmentary view of the rotor taken along line 8—8 of FIG. 7.
Figure 9:
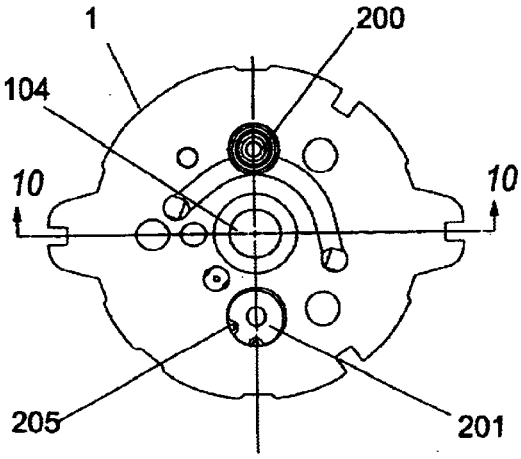
FIG. 9 shows a top-down view of the rotor of FIG. 6.
Figure 10:
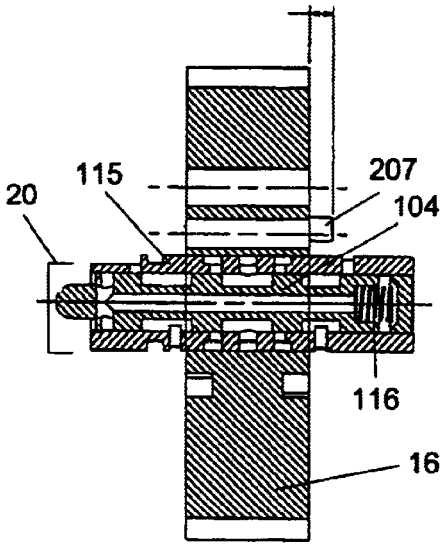
FIG. 10 shows a fragmentary view of the rotor taken along line 10—10 of FIG. 9.

Referring to FIG. 1, a rotor (1) is fixedly positioned on the camshaft (9), by means of mounting flange (8), to which it (and rotor front plate (4)) is fastened by screws (14). The rotor (1) has a diametrically opposed pair of radially outwardly projecting vanes (16), which fit into recesses (17) in the housing body (2). The inner plate (5), housing body (2), and outer plate (3) are fastened together around the mounting flange (8), rotor (1) and rotor front plate (4) by screws (13), so that the recesses (17) holding the vanes (16), enclosed by outer plate (3) and inner plate (5), form fluid-tight chambers. The timing gear (11) is connected to the inner plate (5) by screws (12). Collectively, the inner plate (5), housing body (2), outer plate (3) and timing gear (11) will be referred to herein as the "housing".

Referring also to FIGS. 2 through 5, the vanes (16) of the rotor (1) fit in the radially outwardly projecting recesses (17), of the housing body (2), the circumferential extent of each of the recesses (17) being somewhat greater than the circumferential extent of the vane (16) which is received in such recess to permit limited oscillating movement of the housing relative to the rotor (1). The vanes (16) are provided with vane tips (6) in receiving slots (19), which are biased outward by linear expanders (7). The vane tips (6) keep engine oil from leaking between the inside of the recesses (17) and the vanes (16), so that each recess is divided into opposed chambers (17*a*) and (17*b*). Thus, each of the chambers (17*a*) and (17*b*) of the housing (2) is capable of sustaining hydraulic pressure. Thus, application of pressure to chambers (17*a*) will move the rotor clockwise relative to the rotor (1), and application of pressure to chambers (17*b*) will move the rotor counterclockwise relative to the rotor (1).

The spool (27) of the spool valve (20) is located within the rotor (1), in a cylindrical recess (25) along its central axis (26). Passageways lead oil from the spool valve to the chambers (17*a*)(17*b*), as will be seen in schematic form below. The engine oil or other operating fluid enters the side of the mounting flange (8) and into the rotor (1) through passage (21). Since the spool valve (20) is in the rotor (1) and not the camshaft (9), the camshaft (9) is much easier to manufacture, since fluid only needs to travel through the phaser into the spool valve (20) in the rotor (1)—no elaborate passages need be machined into the camshaft (9), and no externally mounted valves are needed. Having the spool valve (20) in the rotor (1) reduces leakage and improves the response of the phaser. This design allows for shorter fluid passages when compared to a control system mounted at the cam bearing.

Referring also to FIGS. 6 through 10, a blown-up view of the rotor (1) shows that the rotor (1) houses the spool valve (109). Spool valve (109) includes a spool (104) and a cylindrical member (115). A retaining ring (150) fits at one end of the spool (104). A plug (202) is pressed flush with the cylindrical member (115) surface. The spring (116) abuts the plug (202). Advance chamber check valve (200) and retard chamber check valve (201) within the rotor (1) include retaining rings (205) and (206), respectively. Set screws (203) are preferably below the surface of the rotor (1). A dowel pin (207) also fits into the rotor (1).

Figure 11:
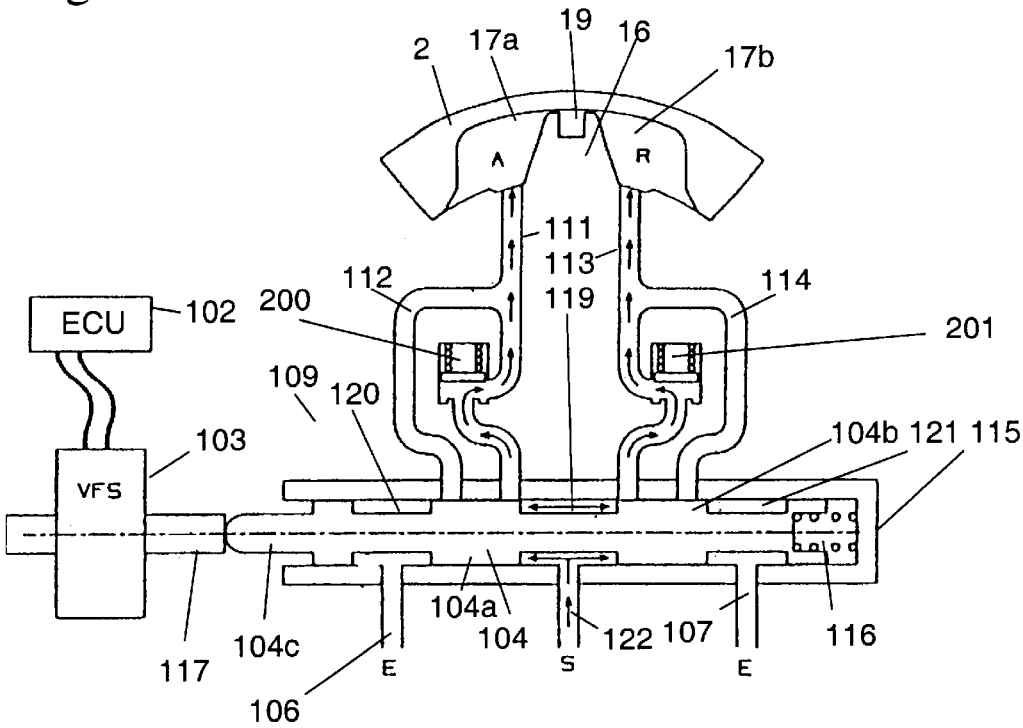
FIG. 11 shows a cam phaser with advance and retard chamber check valves in the null position in a preferred embodiment of the invention.
Figure 12:
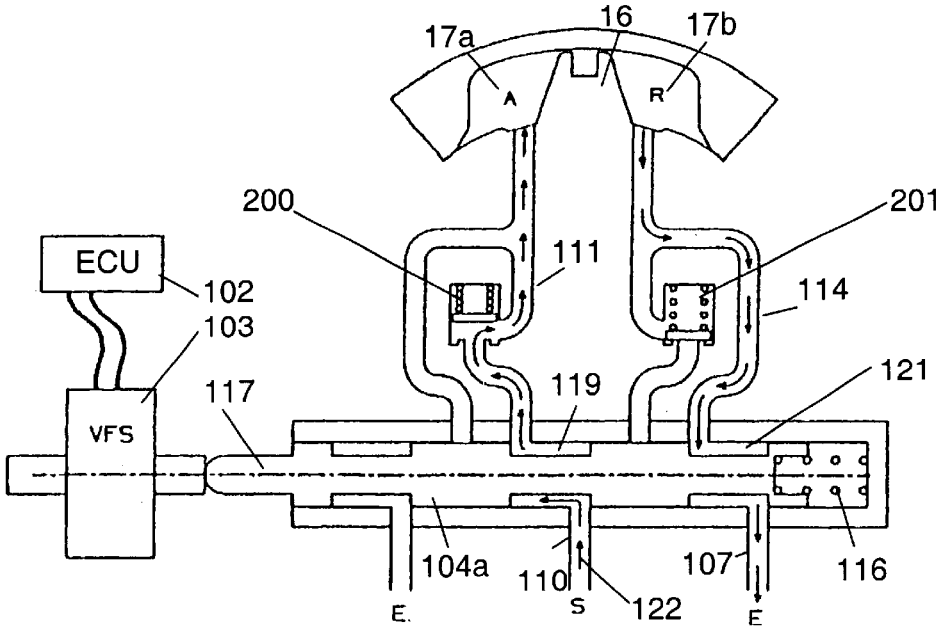
FIG. 12 shows a cam phaser with advance and retard chamber check valves in the advance position in a preferred embodiment of the invention.
Figure 13:
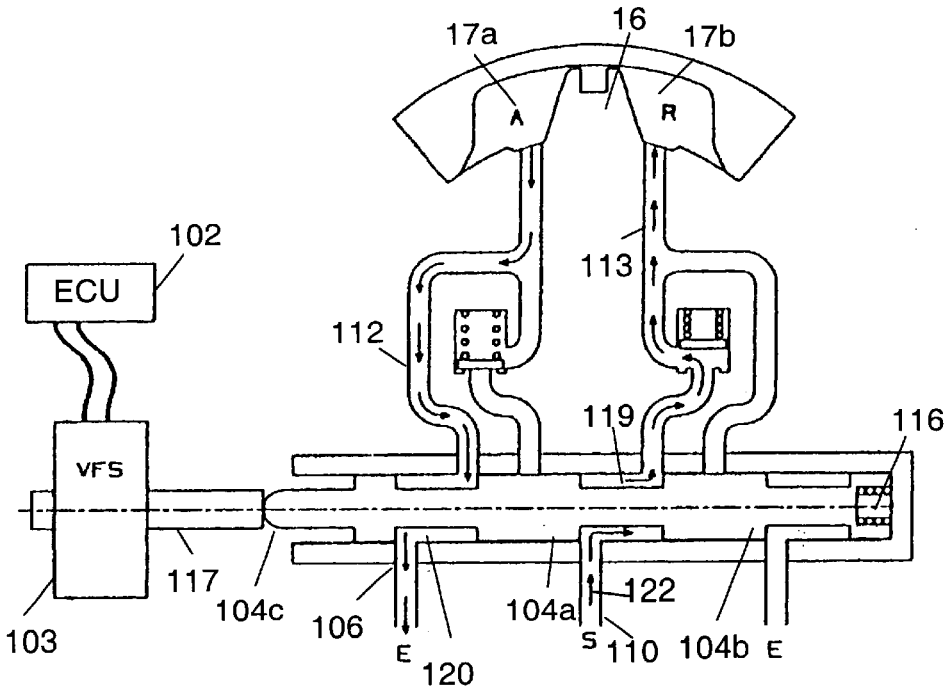
FIG. 13 shows a cam phaser with advance and retard chamber check valves in the retard position in a preferred embodiment of the invention.

Referring also to FIGS. 11 through 13, the phaser operating fluid (122), illustratively in the form of engine lubricating oil, flows into the recesses (17*a*) (labeled "A" for "advance") and (17*b*) (labeled "R" for "retard") by way of a common inlet line (110). Advance chamber check valve (200) is located in the advance chamber inlet line (111) while retard chamber check valve (201) is located in the retard chamber inlet line (113). The main advantage to putting the check valves in the advance and retard chambers instead of having a single check valve in the supply is to reduce leakage. Placing the check valves (200) and (201) between the chambers and the spool valve (109) eliminates high pressure oil flow across the spool valve (109). It also improves the response time of the check valves (200) and (201) to the torque reversals due to a shorter oil path. A second advantage to a Torsional Assist phaser as compared to an Oil Pressure Actuated device is oil consumption. The Torsional Assist phaser outperforms an Oil Pressure Actuated device and consumes less oil.

Inlet line (110) terminates as it enters the spool valve (109). As discussed above, the spool valve (109) is made up of a spool (104) and a cylindrical member (115). The spool (104), which is preferably a vented spool, is slidable back and forth. The spool (104) includes spool lands (104*a*) and (104*b*) on opposed ends thereof, which fit snugly within cylindrical member (115). The spool lands (104*a*) and (104*b*) are preferably cylindrical lands and preferably have three positions, described in more detail below.

Control of the position of spool (104) within member (115) is in direct response to a variable force solenoid (103). The variable force solenoid (103) is preferably an electromechanical actuator (103). U.S. Pat. No. 5,497,738, entitled "VCT Control with a Direct Electromechanical Actuator", which discloses the use of a variable force solenoid, issued Mar. 12, 1996, is herein incorporated by reference. Briefly, in the preferred embodiment an electrical current is introduced via a cable through the solenoid housing into a solenoid coil which repels, or "pushes" an armature (117) in the electromechanical actuator (103). The armature (117) bears against extension (104*c*) of spool (104), thus moving spool (104) to the right. If the force of spring (116) is in balance with the force exerted by armature (117) in the opposite direction, spool (104) will remain in its null or centered position. Thus, the spool (104) is moved in either direction by increasing or decreasing the current to the solenoid coil, as the case may be. In an alternative embodiment, the configuration of electromechanical actuator (103) may be reversed, converting the force on spool extension (104*c*) from a "push" to a "pull." This alternative requires the function of spring (116) to be redesigned to counteract the force in the new direction of armature (117) movement.

The variable force electromechanical actuator (103) allows the spool valve to be moved incrementally instead of only being capable of full movement to one end of travel or the other, as is common in conventional camshaft timing devices. The use of a variable force solenoid eliminates slow dynamic response. The faster response allows the use of increased closed-loop gain, making the system less sensitive to component tolerances and operating environment. Also, a variable force solenoid armature only travels a short distance, as controlled by the current from the Engine Control Unit (ECU) (102). In a preferred embodiment, an electronic interface module (EIM) provides electronics for the VCT. The electronic interface module interfaces between the actuator (103) and the Engine Control Unit (102).

Because the travel required rarely results in extremes, chattering is eliminated, rendering the system virtually noise-free. Perhaps the most important advantage over the conventional differential pressure control system is the improved control of the basic system. A variable force solenoid provides a greatly enhanced ability to quickly and accurately follow a command input of VCT phase.

Preferred types of variable force solenoids include, but are not limited to, a cylindrical armature, or variable area, solenoid, and a flat faced armature, or variable gap, solenoid. The electromechanical actuator employed could also be operated by a pulse-width modulated supply. Alternatively, other actuators such as hydraulic solenoids, stepper motors, worm- or helical-gear motors or purely mechanical actuators could be used to actuate the spool valve within the teachings of the invention.

To maintain a phase angle, the spool (104) is positioned at null, as shown in FIG. 11. The camshaft (9) is maintained in a selected intermediate position relative to the crankshaft of the associated engine, referred to as the "null" position of the spool (104). Make up oil from the supply fills both chambers (17*a*) and (17*b*). When the spool (104) is in the null position, spool lands (104*a*) and (104*b*) block both of the return lines (112) and (114), as well as inlet lines (111) and (113). Both of the check valves (200) and (201) are open when the device is in the null position.

Since the hydraulic fluid (122) is essentially trapped in the center cavity (119) of the spool valve (103), the pressure is maintained, and hydraulic fluid (122) does not enter or leave either of the chambers (17*a*) and (17*b*). However, there is inevitably leakage from the chambers (17*a*) and (17*b*). So, the spool valve is "dithered" to allow a small bit of movement. That is, the spool (104) wiggles back and forth enough so that if the advance (17*a*) and retard (17*b*) chambers begin losing pressure, make-up fluid (122) restores the pressure. However, the movement is not sufficient to let fluid out exhaust ports (106) and (107). Center cavity (119) is preferably tapered at the edges to allow easier transport of make-up fluid during dithering.

Since the force of armature (117) corresponds to the electrical current applied to the solenoid coil, and the force of spring (116) is also predictable (with respect to spring position), the position of spool (104) is readily ascertainable based on solenoid current alone. By using only imbalances between an electrically-generated force on one end (104*b*) of spool (104) and a spring force on the other end (104*a*) for movement in one direction or another (as opposed to using imbalances between hydraulic loads from a common source on both ends), the control system is completely independent of hydraulic system pressure. Thus, it is not necessary to design a compromised system to operate within a potentially wide spectrum of oil pressures, such that may be attributed to individual characteristics of particular engines. In that regard, by designing a system which operates within a narrower range of parameters, it is possible to rapidly and accurately position the spool (104) in its null position for enhanced operation of a VCT system.

Referring to FIG. 12, to advance the phaser, source hydraulic fluid (122) is ported to the advance chamber (17*a*) by shifting the spool (104) to the left. At the same time, the retard chamber (17*b*) is exhausted to atmosphere—that is, to a location of lower pressure, where the fluid may be recycled back to the fluid source. In most cases, "atmosphere" means into a location where the engine oil can drain back into the oil pan at the bottom of the engine, for example into the timing chain cover or a return line connected to the oil pan. Advance chamber check valve (200) is now open, allowing the entry of source hydraulic fluid (122) into the advance chamber (17*a*). Retard chamber check valve (201) is closed, further preventing any source hydraulic fluid (122) to enter the retard chamber (17*b*) through retard chamber inlet line (113). In this configuration, land (104*b*) blocks the entrance of hydraulic fluid into the retard chamber inlet line (113). Cavity (119) is now lined up with advance chamber inlet line (111), allowing additional hydraulic fluid (122) to enter the retard chamber (17*a*). Land (104*a*) blocks the exit of hydraulic fluid (122) from the advance chamber return line (112). Cavity (121) allows the exhaust of hydraulic fluid (122) through the retard chamber return line (114) and out the retard chamber exhaust (107) to atmosphere.

Referring to FIG. 13, to retard the phaser, the spool (104) is moved to the right, and source hydraulic fluid (122) is ported to the retard chamber (17*b*) and the hydraulic fluid (122) in the advance chamber (17*a*) is exhausted to the atmosphere. Retard chamber check valve (201) is now open, allowing the entry of source hydraulic fluid (122) into the retard chamber (17*b*). Advance chamber check valve (200) is closed, further preventing any source hydraulic fluid (122) to enter the advance chamber (17*a*) through advance chamber inlet line (111). In this configuration, land (104*b*) blocks the exit of hydraulic fluid from retard chamber return line (114). Cavity (119) is now lined up with retard chamber inlet line (113), allowing hydraulic fluid (122) into the retard chamber (17*b*). Land (104*a*) blocks the entry of hydraulic fluid (122) into advance chamber inlet line (111). Cavity (120) allows the exhaust of hydraulic fluid (122) through the advance chamber return line (112) and out the advance chamber exhaust (106) to atmosphere.

In a preferred embodiment, a lock mechanism is included for start up, when there is insufficient oil pressure to hold the phaser in position. For example, a single position pin can be inserted into a hole, locking the rotor and housing together, or another shift and lock strategy as known to the art used.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser for adjusting timing between a camshaft and a crankshaft of an engine, comprising:

a rotor having a plurality of circumferentially spaced apart vanes and a central cylindrical recess located along an axis of rotation, the rotor being connectable to the camshaft for rotation therewith;

a housing connectable to the crankshaft for rotation therewith, having a body coaxially surrounding the rotor, the body having a plurality of recesses circumferentially spaced apart for receiving the vanes of the rotor, and permitting rotational movement of the vanes therein, wherein each of the vanes divides one of the recesses into a first portion and a second portion, the first portion and the second portions being capable of sustaining fluid pressure, such that introduction of a fluid under pressure into the first portion causes the rotor to move in a first rotational direction relative to the housing and introduction of a fluid under pressure into the second portion causes the rotor to move in an opposite rotational direction relative to the housing; and a spool located within the cylindrical recess of the rotor and being slidably movable along the axis of rotation of the rotor, the spool comprising a plurality of lands which block and connect a plurality of passageways in the rotor, such that by slidably moving the spool in the cylindrical recess of the rotor, the flow of fluid from an output of a source of fluid under pressure to the first portions and the second portion is controlled, varying the rotational movement of the housing relative to the rotor;

wherein the central cylindrical recess of the rotor comprises:

a first movement line connecting the cylindrical recess to the first portion;

a first check valve located within the first movement line, such that the first check valve is positioned to permit flow of fluid into the first portion;

a second movement line connecting the cylindrical recess to the second portion; and a second check valve located within the second movement line, such that the second check valve is positioned to permit flow of fluid into the second portion.

2. The phaser of claim 1, in which the spool comprises length and a first land and a second land, spaced apart a distance along the length, such that the first land and the second land have a circumference which provides a fluid blocking fit in the cylindrical recess, and the length has a lesser circumference than the first land and second land to permit fluid to flow; and the cylindrical recess of the rotor further comprising, in spaced-apart relationship along a length of the cylindrical recess from a first end of the cylindrical recess most distant from the camshaft to a second end of the cylindrical recess closest to the camshaft:

a first exhaust vent connecting the cylindrical recess to atmosphere;

a first return line connecting the first portion to the cylindrical recess;

a central inlet line connecting a central location in the cylindrical recess to a source of fluid;

a second return line connecting the second portion to the cylindrical recess;

a second exhaust vent connecting the cylindrical recess to atmosphere;

the first exhaust vent, second exhaust vent, first return line, second return line, first movement line, second movement line and central inlet line being spaced apart along the length of the cylindrical recess, and the first land and the second land being of sufficient length and distance apart such that:

when the spool is in a central position between the first end of the central recess and the second end of the central recess, the first check valve and the second check valve are both open, the first land blocks the first return line and the first movement line, and the second land blocks the second movement line and the second return line;

when the spool is in a position nearer the first end of the central recess, the first movement line and second return line are unblocked, the first check valve is open, the second check valve is closed, fluid from the central inlet line flows into the first movement line and the first portion, and fluid from the second portion flows into the second return line and the second exhaust vent; and when the spool is in a position nearer the second end of the central recess, the second movement line and first return line are unblocked, the first check valve is closed, the second check valve is open, fluid from the central inlet line flows into the second movement line and the second portion, fluid from the first portion flows into the first return line and the first exhaust vent.

3. The phaser of claim 1, further comprising a variable force actuator, such that the variable force actuator controls the position of the spool in response to a signal issued from an engine control unit.

4. The phaser of claim 3, wherein the variable force actuator is an electromechanical variable force solenoid.

5. The phaser of claim 4, further comprising a spring for biasing the spool valve to a full advance position during periods when the electromechanical variable force solenoid is deenergized.

6. The phaser of claim 3, wherein the signal from the ECU to the variable force actuator is a pulse-width modulated.

7. The phaser of claim 1, wherein the fluid comprises engine lubricating oil.

8. An internal combustion engine, comprising:

a crankshaft, the crankshaft being rotatable about a first axis;

a camshaft, the camshaft being rotatable about a second axis, the camshaft being subject to torque reversals during rotation thereof;

a phaser for adjusting timing between a camshaft and a timing gear coupled to a crankshaft of an engine, comprising:

a rotor having first and second circumferentially spaced apart vanes and a central cylindrical recess located along an axis of rotation, the rotor being connectable to the camshaft for rotation therewith;

a housing connectable to the timing gear for rotation therewith, having a body coaxially surrounding the rotor, the body having a plurality of recesses circumferentially spaced apart for receiving the vanes of the rotor, and permitting rotational movement of the vanes therein, wherein each of the vanes respectively divides one of the recesses into a first portion and a second portion, the first portion and the second portion of the first recess and the second recess being capable of sustaining fluid pressure, such that introduction of a fluid under pressure into the first portion causes the rotor to move in a first rotational direction relative to the housing and introduction of a fluid under pressure into the second portion causes the rotor to move in an opposite rotational direction relative to the housing;

a spool located within the cylindrical recess of the rotor and being slidably movable along the axis of rotation of the rotor, the spool comprising a plurality of lands which block and connect a plurality of passageways in the rotor, such that by slidably moving the spool in the cylindrical recess of the rotor, the flow of fluid from a fluid input to the first portion and the second portion is controlled, varying the rotational movement of the housing relative to the rotor;

an electromechanical actuator mechanically coupled to the spool; and an engine control unit coupled to the electromechanical actuator, such that, the electromechanical actuator controls the position of the spool in response to a signal issued from the engine control unit;

wherein the central cylindrical recess of the rotor comprises:

a first movement line connecting the cylindrical recess to the first portion;

a first check valve located within the first movement line, such that the first check valve is positioned to permit flow of fluid into the first portion;

a second movement line connecting the cylindrical recess to the second portion; and a second check valve located within the second movement line, such that the second check valve is positioned to permit flow of fluid into the second portion.

9. The internal combustion engine of claim 8, in which:

the spool comprises length and a first land and a second land, spaced apart a distance along the length, such that the first land and the second land have a circumference which provides a fluid blocking fit in the cylindrical recess, and the length has a lesser circumference than the first land and second land to permit fluid to flow; and the cylindrical recess of the rotor further comprising, in spaced-apart relationship along a length of the cylindrical recess from a first end of the cylindrical recess most distant from the camshaft to a second end of the cylindrical recess closest to the camshaft:

a first exhaust vent connecting the cylindrical recess to atmosphere;

a first return line connecting the first portion to the cylindrical recess;

a central inlet line connecting a central location in the cylindrical recess to a source of fluid;

a second return line connecting the second portion to the cylindrical recess;

a second exhaust vent connecting the cylindrical recess to atmosphere;

the first exhaust vent, second exhaust vent, first return line, second return line, first movement line, second movement line and central inlet line being spaced apart along the length of the cylindrical recess, and the first land and the second land being of sufficient length and distance apart such that:

when the spool is in a central position between the first end of the central recess and the second end of the central recess, the first check valve and the second check valve are both open, the first land blocks the first return line and the first movement line, and the second land blocks the second movement line and the second return line;

when the spool is in a position nearer the first end of the central recess, the first movement line and second return line are unblocked, the first check valve is open, the second check valve is closed, fluid from the central inlet line flows into the first movement line and the first portion, and fluid from the second portion flows into the second return line and the second exhaust vent; and when the spool is in a position nearer the second end of the central recess, the second movement line and first return line are unblocked, the first check valve is closed, the second check valve is open, fluid from the central inlet line flows into the second movement line and the second portion, and fluid from the first portion flows into the first return line and the first exhaust vent.

10. The internal combustion engine of claim 8, further comprising a variable force actuator, such that the variable force actuator controls the position of the spool in response to a signal issued from an engine control unit.

11. The internal combustion engine of claim 10, wherein the variable force actuator is an electromechanical variable force solenoid.

12. The internal combustion engine of claim 11, further comprising a spring for biasing the spool valve to a full advance position during periods when the electromechanical variable force solenoid is deenergized.

13. The internal combustion engine of claim 10, wherein the variable force actuator is a pulse-width modulated solenoid.

14. The internal combustion engine of claim 8, wherein the fluid comprises engine lubricating oil.

* * * * *